United States Patent [19]

Gallis

[11] 4,422,617

[45] Dec. 27, 1983

[54] EDGE JOIST

[75] Inventor: Anthony J. Gallis, Lake Hiawatha, N.J.

[73] Assignee: Harsco Corporation, Camp Hill, Pa.

[21] Appl. No.: 339,776

[22] Filed: Jan. 15, 1982

[51] Int. Cl.[3] ..... E04G 11/00

[52] U.S. Cl. ..... 249/19; 249/20; 249/34; 249/189; 249/210; 249/219 W

[58] Field of Search ..... 249/189, 205, 210, 219 R, 249/34, 20, 19, 207, 192, 219 W

[56] References Cited

U.S. PATENT DOCUMENTS

| | | | |
|---|---|---|---|
| 1,291,257 | 1/1919 | Thompson . | |
| 1,681,286 | 8/1928 | Fasshauer . | |
| 2,637,889 | 5/1953 | Dulleck . | |
| 3,067,479 | 12/1962 | Schimmel . | |
| 3,411,743 | 11/1968 | Hawkins . | |
| 3,486,729 | 12/1969 | Schimmel | 249/189 |
| 3,736,718 | 6/1973 | Sylvan | 52/720 |
| 3,839,839 | 10/1974 | Tillisch et al. . | |
| 3,899,152 | 8/1975 | Avery | 249/189 X |
| 3,943,680 | 3/1976 | Balinski . | |
| 4,033,544 | 7/1977 | Johnston . | |
| 4,065,540 | 12/1977 | Okami | 264/278 |
| 4,152,878 | 5/1979 | Balinski . | |
| 4,192,481 | 3/1980 | Durbin . | |
| 4,228,986 | 10/1980 | Schimmel et al. | 249/205 X |
| 4,283,892 | 8/1981 | Brown . | |
| 4,356,993 | 11/1982 | Gallis et al. | 249/38 X |

OTHER PUBLICATIONS

M. K. Hurd, Formwork for Concrete, American Concrete Institute, 2nd Ed., 1969, pp. 90–101.

*Primary Examiner*—Jay H. Woo
*Assistant Examiner*—James C. Housel

[57] ABSTRACT

An edge joist is provided for installation along an edge of a wallform sheathing panel. The edge joist is generally formed as a S-beam. A front flange thereof is generally L-shaped and engages the rear surface of the panel at one edge thereof. A rear flange is arranged generally parallel to the front flange and has a provision, such as a T-channel bolt slot, for connecting to wallform walers. A stepped web connects the lower edge of the front flange to an upper edge of the rear flange, and preferably includes a lower web plate extending back from the lower edge of the front flange, a riser extending slopingly back and upward from the rear plate, and an upper web plate extending rearward from the top of the riser to the rear flange. The front flange can have a toe plate overlapping and protecting the panel edge and a flange plate extending upward along the rear surface of the panel. Preferably, beads are formed along the lower surface of the web lower plate to form seals when edge joists are butted together. The edge joist so constructed will nest securely in a shear wall support bracket. It can also be used to form a secure joining member with a like joist on an adjacent wallform panel.

12 Claims, 6 Drawing Figures

EDGE JOIST

FIELD OF THE INVENTION

This invention relates to wallforms, especially those suitable for use in fabricating concrete walls. In particular, this invention is directed to an edge joist to be mounted at an edge of a sheathing panel of a wallform system.

BRIEF DESCRIPTION OF THE PRIOR ART

Wallforms for forming a large poured concrete wall generally comprise a pair of opposed sheathing panels rigidly buttressed by a support structure including, for example, wooden studs or metal joists backed by load-gathering walers arranged perpendicularly to the joists (which walers in larger structures often are further supported by strongbacks).

The sheathing panels, which are typically made from plywood, may alternatively include fiberglass panels and other non-wood panels (especially where special architectural effects are desired).

The panels may initially be held apart by separator blocks which can be removed as the concrete is poured into the wallform. However, to oppose the outward pressure of the wet concrete against the panel forms, tie rods typically are used. Each rod extends through the sheathing from a waler on one side to a corresponding waler on the other side. Metal tie plates, functioning essentially as washers, are positioned on the free side of the walers to receive the ends of the tie rods.

Typical wallform panels are shown in Formwork for Concrete by M. K. Hurd, 2d Ed. (1969, American Concrete Institute). Over the years, several variations have been proposed; e.g., see U.S. Pat. Nos. 3,899,152; 3,067,479; 4,192,481 and 4,033,544.

In recent decades, particularly for larger construction jobs, the support structure for the paneling has been formed of metal modified I-beams rather than conventional wooden beams. In order to facilitate nailing, a wood or woodlike nailer strip is frequently incorporated into a so-called inverted "top hat" portion of the metal joists. When extruded from aluminum, conventional bolt channels are often included in the flange of the modified I-beam joists (opposite the flange carrying the wooden nailer strip) to facilitate the use of bolts in connecting the aluminum joists to metal walers or other equipment.

In the construction of large poured vertical structures, particularly shear walls, it has become conventional to use ganged forms. For example, a twenty foot by twenty four foot ganged wallform would be made typically from 15 four foot by eight foot sheathing panels, each backed by respective metal joists, and tied together by long walers and strongbacks. This ganged structure can be treated as a unit and moved vertically by a crane when a lower section of the wall is sufficiently cured so that the next section can be poured above it. In order to facilitate the use of a ganged structure, a support bracket is fastened to the cured wall section near its top, and the lowest joist of the ganged wallform structure is supported thereby during the pouring of the next section.

Unfortunately, whether ganged or not, the lower edge of the sheathing panel is either not directly supported, or is supported only by a conventional joist. In either case the panel lower edge does not fit well into the support bracket, and special custom-built wood-blocking interfit structure has to be constructed each time to give the necessary support to the bottom of the wallform. This structure has to be carefully aligned with the lower edge of the panel so that a flush surface is presented at the edge of the sheathing. Additional time and added labor are required in preparing the wood blocking for each such panel.

Also, if the ganged wallform structure is disposed to form the lowest wall section, the lower sheathing panel edge must be placed flush with a footing or decking structure. Consequently, wet cement tends to leak out and harden, both on the decking, and on the panel edge or on wood blocking disposed thereon. This hardened leakage must, of course, be cleaned off before the ganged wallform structure can be used to form other wall sections. However, the necessary removal of the hardened cement from the wood on other woodlike material at the sheathing panel edge takes a significant time to accomplish, thereby adding to construction time and requiring still additional labor.

OBJECTS AND SUMMARY OF THE INVENTION

Accordingly, it is an object of this invention to provide a wallform system that incorporates an edge joist avoiding the drawbacks of prior wallform systems.

More specifically, it is an object of this invention to provide an edge joist formed of a simple construction and which is easily installed at an edge of a sheathing panel, yet does not require wood blocking or other similar construction for reposing in the support of a shear wall support bracket.

It is a further object to provide a novel edge joist suitable for use together with conventional aluminum "top hat" I-beam joists, conventional panelling, and conventional walers to form a unique ganged wallform structure.

It is a still further object to provide an edge joist which can form relatively fluid-tight seams (1) between adjacent panels carrying such mating edge joists and (2) between the bottom of a panel carrying such an edge joist and the top of an already-formed wall on which the panel is mounted.

In this connection, it is an object of this invention to provide an edge joist which can accommodate some build-up of hardened leakage cement at the panel edge without adverse edge-to-edge mating problems between adjacent wallforms, which also enables rapid removal of such hardened cement when necessary, and which at the same time permits the structure to rest directly on a shear wall support bracket, on a footing sill, or on horizontal decking without need to provide special adaptive additional structure.

According to a preferred embodiment of this invention, such an edge joist comprises a beam where cross-section is generally in the shape of an S. A front flange, generally in the shape of an L, engages the rear surface of the panel at one of its edges. A rear flange generally parallel to the front flange is provided for connecting to the walers. Connecting the lower edge of the front flange to an upper edge of the rear flange is a stepped web. The stepped web preferably includes a lower plate extending back from the lower edge of the front flange, a riser extending upwards from the rear of the lower plate, and an upper plate extending rearward from the top of the riser to the rear flange.

In the preferred embodiment, a T-bolt channel is included at the juncture of the web upper plate with the rear flange to facilitate fastening the edge joist to the walers by means of bolt clips. Also in the preferred embodiment, a forwardly-directed flange lip is provided on the lower edge of the rear flange to form an interior hook.

The front flange has a toe plate for overlapping and protecting the panel edge and has a flange plate extending upward to face and engage the rear surface of the sheathing panel. Screw or bolt holes can be provided along this flange plate to permit fastening the edge beam to the panel.

The flange plate and the toe plate together have an L cross section. Preferably, the toe plate is somewhat thicker at its forward edge than at its junction with the flange plate, thereby presenting an upper toe plate surface that rises slightly in the forward direction. This provides a snug fit against the lower edge of the panel.

Preferably, beads are formed along the front and rear of the lower surface of the toe plate and along the lower plate of the web to extend downwardly. When respective lower surfaces of adjacent edge joists are bolted together, these beads serve as seals to prevent leakage of concrete. Also, any leakage of hardened and wet concrete escaping below the panel lower edge will tend to harden and collect between the beads, where it will not, when solidified, adversely affect the seal. As the thickness of the adherent concrete builds up, it can more easily be scraped off.

The front flange, lower web plate, and web riser form a structure which can nest directly in a shear wall support bracket. Preferably, the riser slopes back slightly, i.e., from about 3–12 degrees from the vertical. When the edge joist is used in a ganged wallform structure to form an upper shear wall section on top of a previously-completed wall section, the slope of the riser engages the vertical lip of the shear wall bracket and assists in wedging the edge of the sheathing panel securely against the surface of the previously-completed wall section.

In this specification and in the accompanying drawings, I have shown and described preferred embodiments of my invention and have suggested various alternatives and modifications thereof; but it is to be understood that these are not intended to be exhaustive and that many other changes and modifications can be made within the scope of the invention. The suggestions herein are selected and included for purposes of illustration in order that others skilled in the art will more fully understand the invention and the principles thereof and will thus be enabled to modify it in a variety of forms, each as may be best suited to the conditions of a particular use.

DETAILED DESCRIPTION

Figure 1:
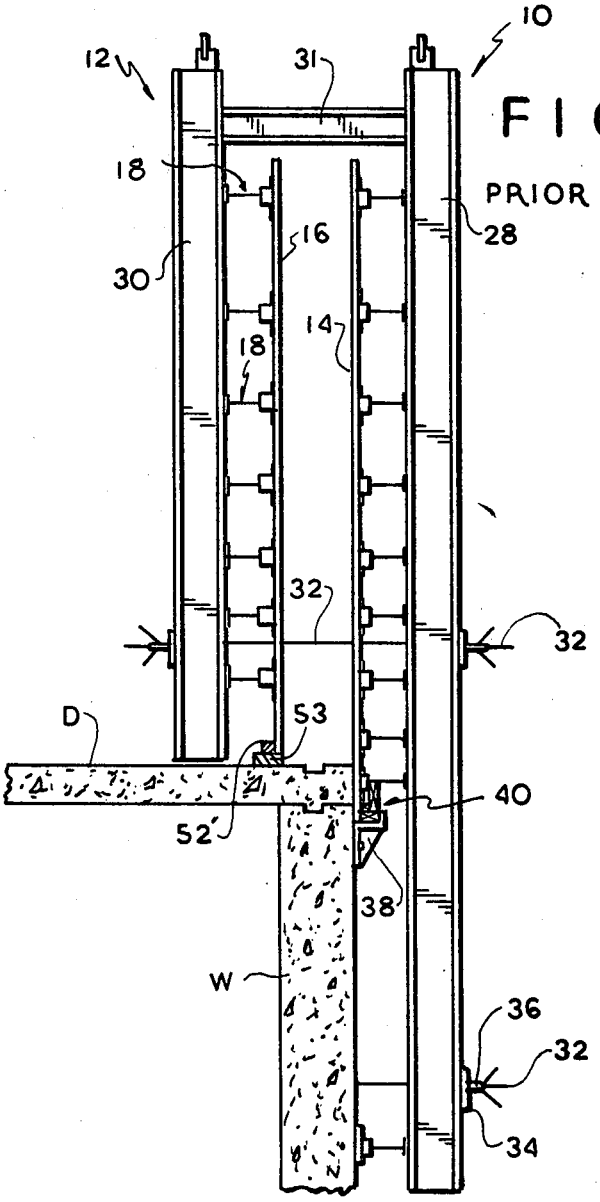
FIG. 1 PRIOR ART
FIG. 1 is side elevation of a wallform system according to a conventional technique now in use.
Figure 2:
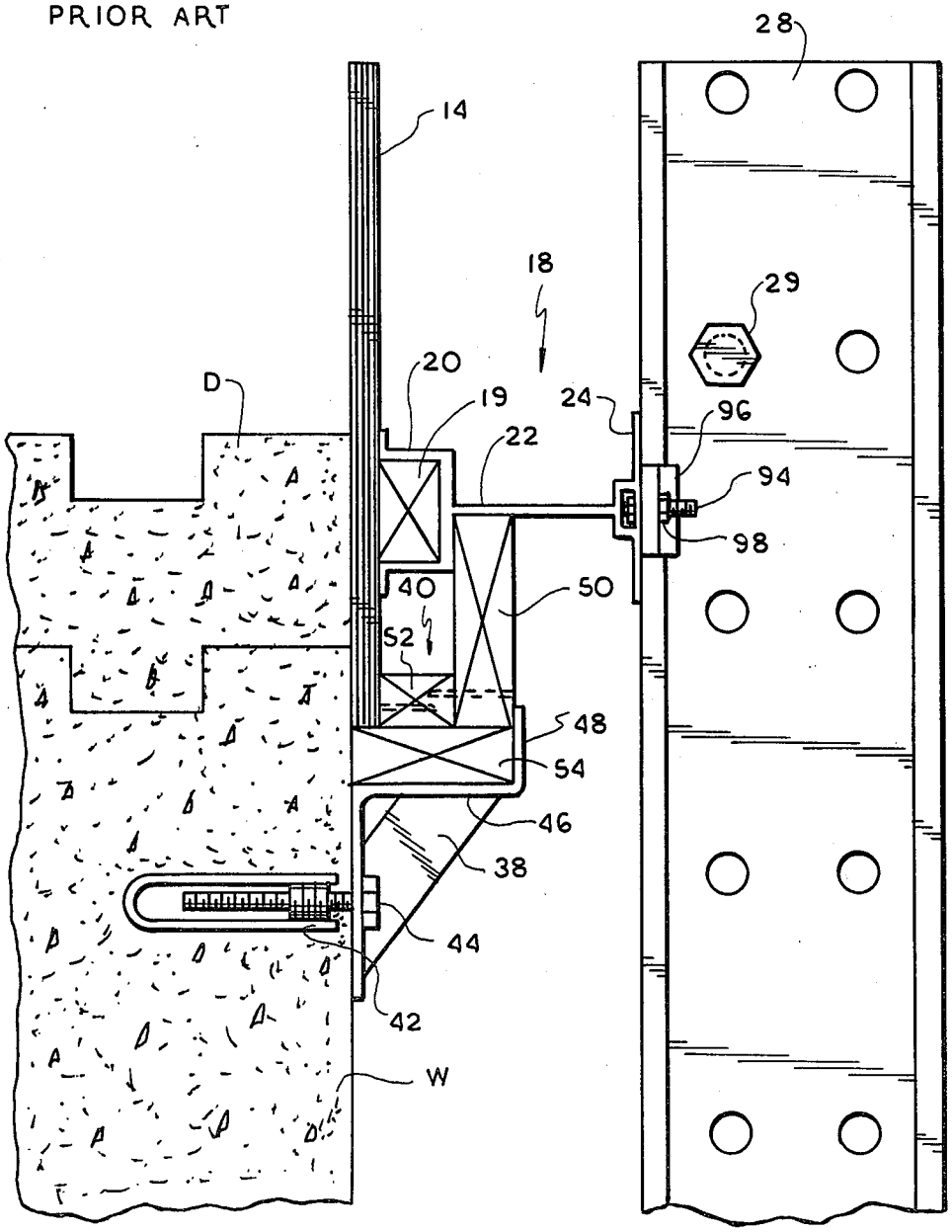
FIG. 2 PRIOR ART
FIG. 2 is an enlarged side elevation showing detail of the conventional system of FIG. 1.

FIGS. 1 and 2 illustrate a joist wallform system typical of those currently in use for forming a poured concrete vertical shear wall. In large construction sites, these wallforms are typically ganged together in units made up of several 4 foot by 8 foot panels (but for simplicity are here shown only one panel high).

As best shown in FIG. 1, a wallform system generally includes an exterior ganged wallform 18 and an interior ganged wallform 12 in facing relation to one another and spaced a predetermined distance apart. Each of the wallforms 10 and 12 has corresponding sheathing panels 14 and 16, between which the wet concrete is to be poured. Support for these panels 14, 16, is provided by a system of parallel modified I-beam joists 18, better shown in detail in FIG. 2. Each of the joists 18 has a section in the form of an inverted top-hat with a nailer 19 inserted therein so that the panel 14 can be connected thereto by nailing. The top-hat section 20 is connected by means of a web 22 to a rear flange 24. The rear flanges 24 of the joists of each wallform 10, 12 are connected to respective walers 28, 30 which run generally perpendicular to the joists 18. These walers 28, 30 are preferably of double channel construction (held together by bolts 29, only one illustrated in FIG. 2), for example, as disclosed in my earlier patent application Ser. No. 225,202 filed Jan. 15, 1981, now U.S. Pat. No. 4,350,318.

A spacing rail 31 is shown fixed in place to hold the wallforms 10, 12 apart, particularly prior to pouring the concrete.

As is well known, when the wet concrete is poured between the panels 14 and 16, a substantial pressure is exerted thereupon, which tends to urge the wallforms outward. To compensate for this, tie rods 32 are installed through the sheathing panels 14 and 16 of the respective wallforms 10 and 12, and are held in place on the walers 28 and 30 by means of tie plates 34 and fastening means, for example, a wing nut 36. It is preferred to use a tie plate such as that disclosed in my earlier patent application Ser. No. 225,202, now U.S. Pat. No. 4,350,318.

The wallforms can be used to construct a rather high shear vertical wall by forming a lower wall section, and then when the concrete of the lower wall section is sufficiently cured, by mounting the wallforms 10 and 12 near the top of the lower shear wall section W. Thus, a successive shear wall section can be poured between the vertical ganged wallforms 10 and 12.

To this end, it is conventional to provide a shear wall support bracket 38 near the top of the shear wall section W to support the lower edge, for example, the sheathing panel 14 of the exterior ganged wallform 10. In order to match the support bracket 38 with support structure, such as the lower-most beam joist 18 on the wallform 10, edge structure 40 formed of wood blocking must be provided, for example, as shown in FIG. 2. As shown in greater detail in FIG. 2, the support bracket 38 is held in place anchored to an insert 42 which is embedded in the concrete at the top of the wall section W, and is held in place by a bolt 44. The bracket 38 has a flat horizontal ledge 46 for supporting a vertical load, and an upstanding flange 48 spaced apart from the surface of the wall section W. As the wood-blocking edge-structure 40 has to accommodate the top hat 20 of the joist 18, a flat 50 and spacer 52 are generally nailed together to the edge of the panel 14. Further, a wood ledger 54 is generally provided with a front edge flush with the interior edge of the panel 14 for supporting the panel 14, the flat 50 and the spacer 52 on the horizontal ledge 46.

It should be apparent that a considerable amount of labor is required in nailing together the wood blocking edge structure 30. This custom work is also wasteful of lumber (having limited useful life). For example, as the lowest joist 18 is not always at exactly the same place on each panel 14, 16, the wooden members 50, 52, and 54 must be individually fit, and planed, where necessary, to insure a good fit.

Where the wallform is supported, on a horizontal structure, such as wooden sill 53 (on decking D, see FIG. 1), the wet concrete at the bottom of the poured wall, being under considerable pressure, will tend to ooze slightly beneath and beyond the edge of the panel 16, and will tend to adhere to any surfaces with which it comes into contact. Thus, a flat wood leveling member, such as sill 53, is typically provided at the foot of the wallform 12 of FIG. 1. If the lower edge of panel 16 is damaged, such leakage can become a problem even with a sill 53; sometimes requiring custom patching, thereby delaying the re-use of the wallform 12, and also adding to the cost of construction.

Conventionally, tie rod 55 is anchored in partial wall W by an anchor 42 against joist 57 (functioning as a compression member). Rod 55 and joist 57 co-act with the lower extension of waler 28 to stabilize the wallform system against pressure from the winds on the panels 12 and 14.

Figure 5:
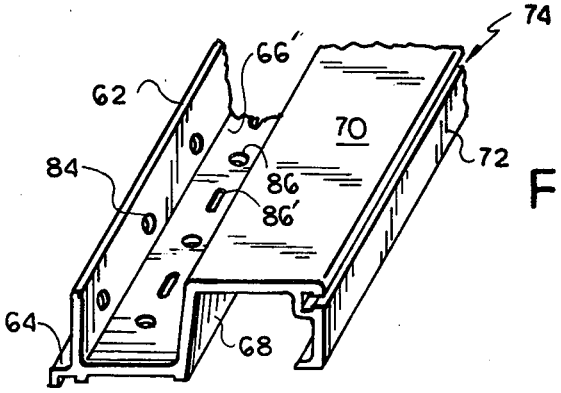
FIG. 5 and FIG. 6 are perspective and elevational end views, respectively, of the edge joist according to the preferred embodiment of this invention.
Figure 3:
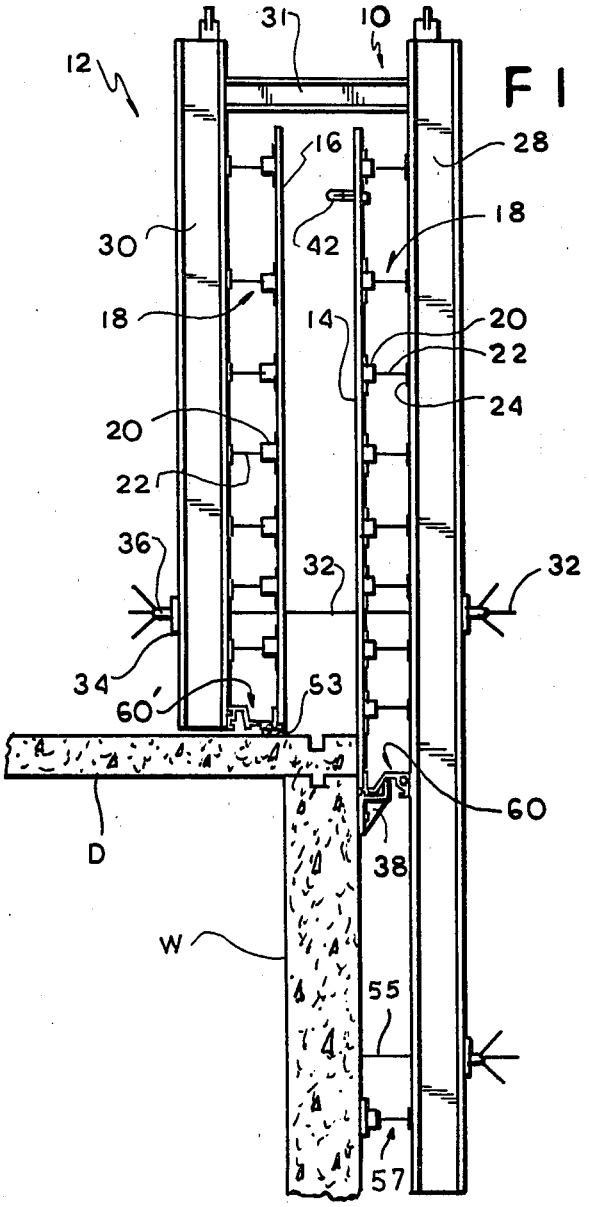
FIG. 3 is a side elevation of an improved wallform system including the edge joist according to a preferred embodiment of this invention.
Figure 6:
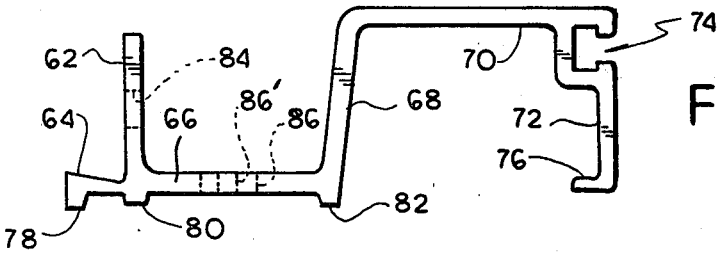
Figure 4:
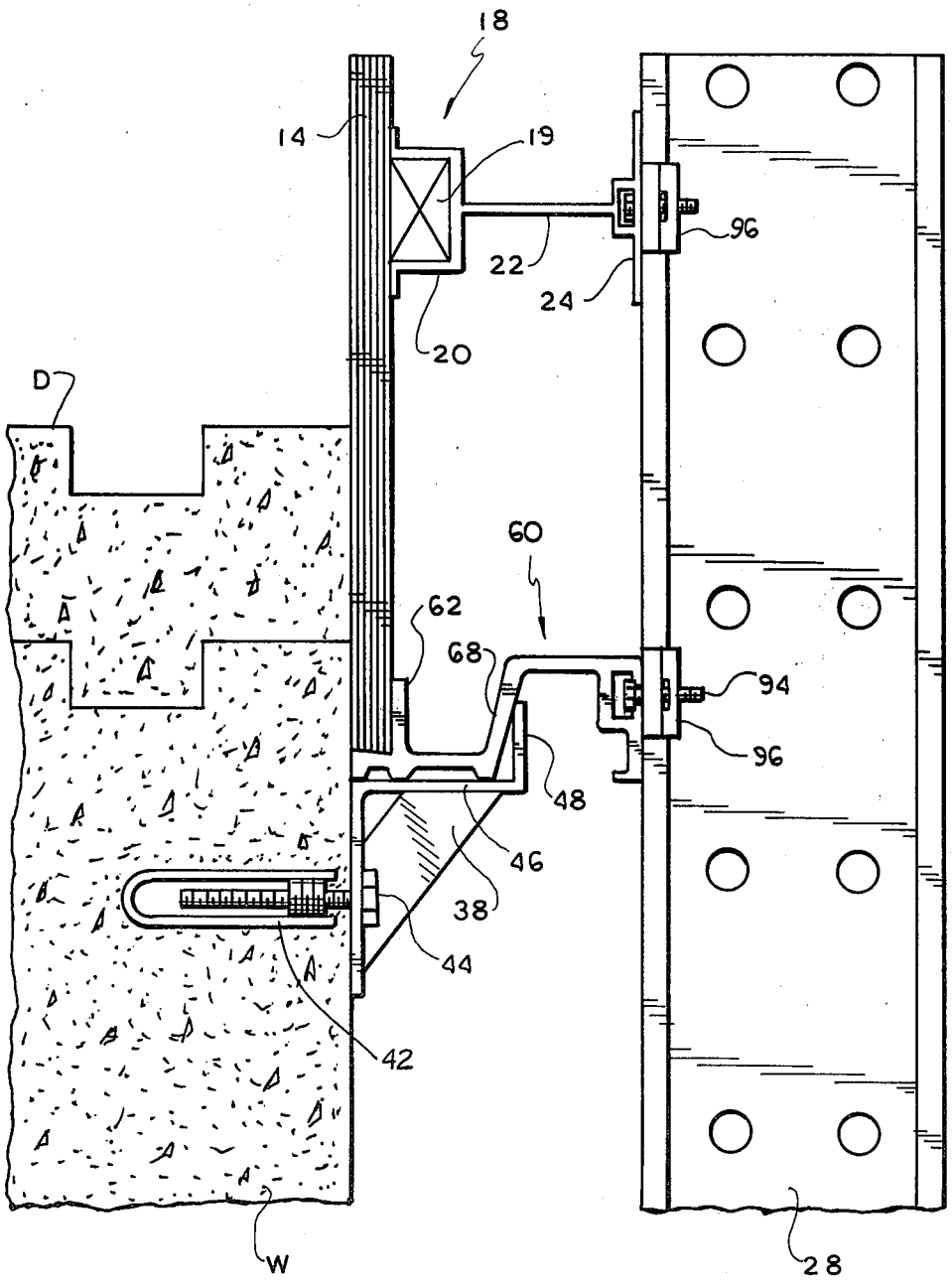
FIG. 4 is an enlarged side elevation showing detail of the improved wallform system of FIG. 3.

Novel wallform structure incorporating the edge joist of this invention is shown in FIGS. 3 and 4, and details of the edge joist are shown in FIGS. 5 and 6.

Elements common both to the prior art structure of FIGS. 1 and 2 and to that of this invention are identified herein with the same reference characters, and a detailed description thereof is omitted. As is apparent from FIG. 3, the formwork 10 and 12 are improved by use of edge joists 60 and 60' disposed at the respective lower edges thereof. The edge joist 60 shown here in cross section nests directly in the shear wall support bracket 38 without need for any custom wood blocking members. The other edge joist 60', at the foot of the wallform sheathing panel 16 rests directly on the decking D. These edge joists 60 and 60' have the same construction, but, because they are disposed on opposite-facing panels 14 and 16, they have a mirror-image relation with respect to each other. The following description is especially applicable to both edge joists.

The edge joist 60 is shown generally as an S-beam, preferably formed of an extruded non-ferrous metal, such as aluminum. Alternatively, magnisium or a lightweight metal or metal alloy can be used. It is preferred that the edge joist be of approximately ¼ inch thick construction throughout.

Overfitting the lower edge of the panel 14 is an L formed of an upstanding front flange 62 extending along the rear surface of the panel 14 and a toe plate 64 extending beneath the edge of the panel 14. A lower web plate 66 extends horizontally, with a front edge joined with the lower edge of the front flange. A riser 68 has a lower edge joined with a rear edge of the lower web plate 66 and extends generally upward therefrom. Then an upper web plate 70 extends from the top of the riser 68 to the top of a rear flange plate 72 which extends generally parallel to the front flange plate 62. A T-slot or bolt channel 74 is formed at the junction of the upper web plate 70 with the rear flange plate 72 to facilitate coupling the edge joist 60 to the respective waler 28. A flange lip 76 extends forward from the lower edge of the rear flange plate 72. As is perhaps best shown in FIGS. 5 and 6, a forward bead 78 is disposed on the lower surface of the toe plate 64 and extends about ¼ inch below the lower surface thereof. Disposed on the lower surface of the lower web plate 66 are further beads 80 and 82 disposed respectively at approximately the juncture of the lower web plate 66 with the front flange 62 and with the riser 68. These beads 80 and 82 extend approximately 15/64 of an inch below the lower surface of the lower web plate 66, and thus their lower surfaces are slightly higher than that of the forward bead 78.

As best shown in FIG. 6, the toe plate is approximately 13/64 inch at its juncture with the front flange 62 and is about ¼ inch at its forward edge. Thus, the toe plate has a flat upper surface that is canted higher at its forward end than at the junction with the front flange.

As shown in FIG. 5, a row of bolt holes or screw holes 84 extend along the front flange plate 62 to facilitate fastening of the edge joist 60 to the associated sheating panel 14. Another row of round bolt holes 86 and/or wedge bolt slots 86' extend along the web's lower plate 66.

Also, as shown in FIG. 6, the riser 68 slopes back slightly from the vertical. That is, in the preferred embodiment, the lower web plate 66 and the riser 68 join at an angle of between about 93° and 102°. In other words, the riser 68 intersects the vertical at an angle of between about 3° to about 12°. Preferably, the angle is about 7°. Returning to FIG. 4, it is seen that the edge joist 60 can be easily coupled to the associated waler 28 by means of a bolt 94 whose head is inserted in the bolt slot 74. A bolt clip 96 can be readily hooked over a flange of the waler 28 and the bolt 94 inserted in a bolt hole extending therethrough and tightened down by means of a nut 98. The same structure 94, 96, 98 is used to fasten the top-hat I-beam joists 18 to the waler 28.

The wallform 10, with the edge joist 60 affixed at a lower edge of the sheathing panel 14 will nest snugly in the shear wall support bracket 38 as shown in FIG. 4. The outwardly sloping riser 68 engages the top edge of the upstanding flange 48 to exert a net inward force (i.e. leftward in FIG. 4) on the panel 14, thus holding the panel 14 snugly against the lower wallform section 14.

It is noted that because the center of force resulting from contact of the upstanding flange 48 with the riser 68 is above the lower web plate 66, the front flange 62 is wedged snugly against the panel 14 (and thus also to act against the resulting pressure of the poured wet concrete). By contrast, with the prior-art wood blocking structure 40 of FIG. 2, there is no similar wedging force vector.

When the edge joist 60' is used disposed directly against a deck D or other horizontal member, the beads 78, 80 and 82 present a small surface area so that the associated wallform 12 rests more snugly against the deck D. This acts to inhibit the undesired flow of wet concrete beneath the edge of the panel 16. Furthermore, any wet cement nonetheless forced out at the foot of the wallform 12 tends to collect on the surface of the forward bead 78. Any hardened concrete on this bead 78 can be easily scraped off, in a time of about one minute or less, by merely running an iron scrapper against it. Also because of the presence of the beads, some build up can be tolerated on plate 66 without adversely affecting the seal and cleaning is not required as often.

Thus, the edge joist of this invention, owing to its stepped web 66, 68, 70, is adapted not only to nest into a shear wall support bracket 38, but also to seat against a deck D and/or a wooden sill or other horizontal structure, as shown with respect to the wallform 12. Thus, the edge joist of this invention can be used in any number of settings without any special adaptations, thereby effecting a considerable savings in material as well as in labor costs.

For example, if a number of panels 14 are ganged together to form a single wall form unit (typically with two pairs or more of walers 28), then edge joists 60 can be advantageously affixed to the peripheral edges of the rectangular wall form unit. Those on the lower peripheral advantageously affixed to the peripheral edges of the rectangular wall form unit. Those on the lower peripheral edge can function as described above (for example, with respect to the shear wall bracket 38). The edge joists 60 on the sides of the wall form unit serve to protect the exposed edges of the wooden paneling 14 and also to form an improved superior seal with corresponding edge joists on abutting gang form units horizontally aligned therewith. In other words, it will be appreciated that the beads 78 and 80 on the lower surface of the plate portion 66 of the edge joist will mate with the corresponding beads on an identical corresponding edge joist on the horizontally adjacent wall form unit. Such face-to-face pairs of joists 60 can be joined in this mirror image orientation by bolts through holes 86 or wedge bolts through slots 86' in the mating lower plates 66 of the respective joists.

The seal between such mating edge joists 60 is improved by bead 78 being slightly higher than the adjacent beads 80 and 82, in turn. Since the edge joist 60 is affixed essentially at right angles to the panel 14, then when two such panels are aligned in a common face, their respective edge joists 60 will first engage along the respective beads 78. This will form a pressure seal along the mating surfaces of these beads 78 as the bolts through the hole 86 or 86' are tightened. The height of the beads 80 and 82 are sufficiently close to the height of the beads 78 so as not to permit the toe 64 from being distorted, and to share in the load on the edge joist (but only after an effective seal has been accomplished).

An advantage of these edge joists 16 is their compatability with the corner-forming members as disclosed in my copending U.S. patent application Ser. No. 225,203 filed Jan. 15, 1981, now U.S. Pat. No. 4,350,318.

Typically, edge joists would not be used on the upper edge of a gang wall form unit, since such units are usually joined horizontally but not vertically. On the other hand, there can be many applications where single-panel wallforms are disassembled relatively often from one ganged wallform unit to be reformed into a different such unit having a different combination of wallforms. In this latter case, it could be advantageous to have edge joists 60 on each of the four edges of the typical single rectangular wallform panel.

From the foregoing, it will be appreciated that the language of orientation used in the foregoing description, such as horizontal, vertical, upright, right, left, forward, rear, upper, lower, etc., is intended for use with reference to the drawings only to simplify the description of the preferred embodiment, and is not intended as a limitation to this invention. It is to be understood that the edge joist of this invention, can and will advantageously repose in any of number of possible orientations.

Also, in high-rise construction it is typical for the walls of the lower floors to require a higher gang form than the upper levels. In this case, the gang would be equipped with edge joists butted up against and secured to each other which would permit the easy removal of sections in the gang form to produce a shorter form for the lower height requirements. This section which is removed can be reattached during any phase of the construction cycle as required.

What is claimed is:

1. An edge joist for use in a wallform system including at least one sheathing panel, joists extending in one direction along said panel for supporting the same, and strengthening walers extending in a generally perpendicular direction behind said joists for supporting the same to form a joist system, the edge joist comprising a metal S-beam and having an upright front flange engageable with a rear surface of said upright sheathing panel with a lower edge of the front flange to be disposed substantially at a straight edge of the panel, a rear flange generally parallel to said front flange, a protective toe plate extending forward from the lower edge of the front flange, and a stepped angled web extending from adjacent said lower edge of said front flange to adjacent an upper edge of said rear flange.

2. An edge joist according to claim 1, wherein said S-beam is made of extruded aluminum.

3. An edge joist according to claim 2, wherein said stepped web includes a lower plate having a front edge joined with the lower edge of said front flange and a rear edge part way toward said rear flange, a riser having a lower edge joined with the rear edge of said lower plate and extending upwardly and rearwardly slopingly therefrom to an upper edge, and an upper plate having a forward edge and a rear edge joined with said upper edges of said riser and said rear flange, respectively.

4. An edge joist according to claim 3, wherein said rear flange is shorter than said front flange and the former includes a T-bolt slot near the upper edge thereof extending the length of said joist and adapted to receive head portions of bolts therein for coupling the rear flange to said walers or to accessories.

5. An edge joist according to claim 4, wherein said lower edge of said rear flange includes a flange lip extending forward and generally perpendicular to said lower edge thereof.

6. An edge joist according to claim 4, wherein said protective toe plate is adapted to engage said straight edge of said sheathing panel and be flush with the front surface thereof.

7. An edge joist according to claim 6, wherein said riser joins said lower plate at an angle of between 93° and 102°.

8. An edge joist according to claim 1, further comprising a protective toe plate extending forward from the lower edge of said front flange adapted to engage said edge of said sheathing panel and be flush with the front surface thereof, and said S-beam is formed of a light weight extruded non-ferrous metal.

9. An edge joist according to claim 7, wherein said toe plate has a flat upper surface extending from said front flange to a forward edge of said toe plate, and said upper surface is canted higher at its forward edge than at said front flange.

10. An edge joist according to claim 9, wherein said angle is substantially 97°.

11. An edge joist according to claim 7, further comprising a forward bead extending the length of said forward edge of the toe plate on a lower surface thereof, and at least one further bead extending parallel thereto along a lower surface of said lower plate.

12. An edge joist according to claim 11 wherein said forward bead extends a predetermined first distance below the lower surface of said lower plate, and said further bead extends a slightly lesser distance below such lower surface.

* * * * *